US006761603B1

(12) United States Patent
Govatzidakis

(10) Patent No.: US 6,761,603 B1
(45) Date of Patent: Jul. 13, 2004

(54) PERSONAL WATER RESCUE DEVICE

(76) Inventor: George J. Govatzidakis, 11 Michael F St., Locust Valley, NY (US) 11560

( * ) Notice: Subject to any disclaimer, the term of this patent is extended or adjusted under 35 U.S.C. 154(b) by 0 days.

(21) Appl. No.: 10/369,789

(22) Filed: Feb. 18, 2003

(51) Int. Cl.[7] ..... B63C 9/00
(52) U.S. Cl. ..... 441/80; 405/186
(58) Field of Search ..... 405/185, 186; 441/80, 83, 89, 136; 446/153

(56) References Cited

U.S. PATENT DOCUMENTS 3,673,696 A * 7/1972 Wasson ..... 33/348
3,776,429 A * 12/1973 DeLucia ..... 222/162
4,344,427 A 8/1982 Marvin
4,409,978 A 10/1983 Bartos
4,498,878 A * 2/1985 Shieh ..... 441/80
4,875,142 A * 10/1989 Spector ..... 362/474
5,113,326 A * 5/1992 Maglica ..... 362/158
5,445,475 A 8/1995 Fujino
5,855,454 A 1/1999 Courtney et al.
5,904,414 A * 5/1999 Monteleone et al. ..... 362/205
5,947,579 A * 9/1999 Horton et al. ..... 362/34
5,947,784 A 9/1999 Cullen
6,551,159 B1 * 4/2003 Spinelli et al. ..... 441/80

* cited by examiner

*Primary Examiner*—Andrew Wright
(74) *Attorney, Agent, or Firm*—Richard L. Miller, P.L.

(57) ABSTRACT

A personal water rescue device. A gas device is connected to a housing and releases gas bubbles. A light device is contained within the housing and illuminates the gas bubbles. The light device includes a pair of vials that contain chemicals that when mixed form chemical illuminance and which communicate with inwardly deformable bulging ribs on the housing so as to allow mixing the chemicals and forming the chemical illuminance when the inwardly deformable bulging ribs are squeezed and their displacement ruptures the pair of vials. A tubular member of the housing terminates in a pin that punctures the gas device when the tubular member is further threaded into a connector sleeve of the housing, and in so doing, releases the gas bubbles for heads up surface positioning for a disoriented water victim, while the chemical illuminance from the light device provides illumination therefor.

5 Claims, 3 Drawing Sheets

Fig. 1
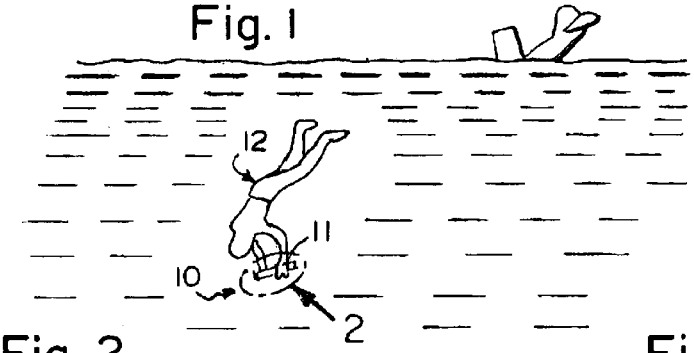
Fig. 2
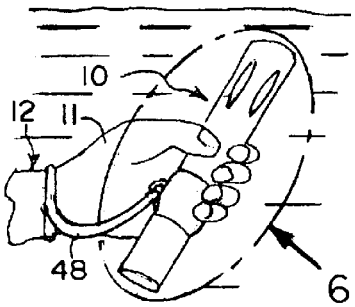
Fig. 3
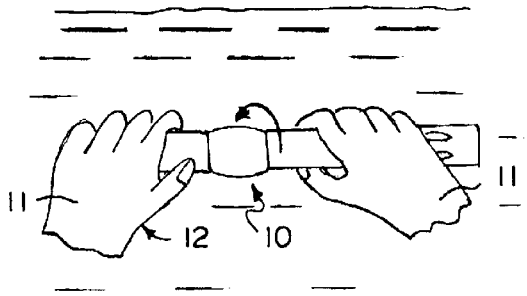
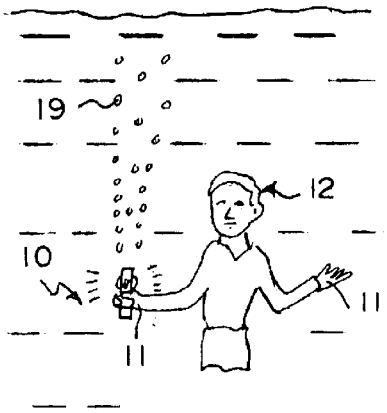
Fig. 5
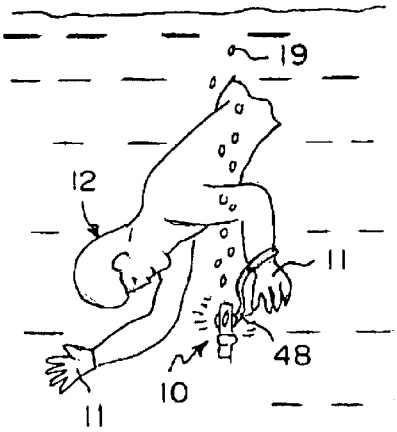
Fig. 4

PERSONAL WATER RESCUE DEVICE

BACKGROUND OF THE INVENTION

1. Field of the Invention

The present invention relates to a rescue device. More particularly, the present invention relates to a personal water rescue device.

2. Description of the Prior Art

Numerous innovations for water related devices have been provided in the prior art that will be described. Even though these innovations may be suitable for the specific individual purposes to which they address, however, they differ from the present invention.

A FIRST EXAMPLE, U.S. Pat. No. 4,344,427 to Marvin teaches an underwater breathing device that is capable of separating breathable gas bubbles from water. A collection reservoir, open at one end is capable of collecting gas and conducting it through a one-way valve to the operator. The one-way valve is provided to conduct exhaled gas to the outside and to prevent it from being exhaled into the collection reservoir.

A SECOND EXAMPLE, U.S. Pat. No. 4,409,978 to Bartos teaches a lightweight portable, self-contained, closed-type breathing apparatus that comprises an oxygen pressure cylinder having connected thereto manually actuated oxygen flow control means. Included is a carbon dioxide scrubber having connected thereto breathing means including check valves and a breathing tube. A flexible breathing bag is provided, as are means for mounting the oxygen cylinder, the flow control means, the scrubber and check valves in fixed mutual relationship, with the oxygen cylinder and scrubber disposed within the breathing bag. The flow control means is constructed upon actuation, to meter flow of oxygen from the cylinder into the breathing bag. The check valves cause a user's exhaled breath to pass through the scrubber before entering the breathing bag. While causing a user to inhale directly from the breathing bag, bypassing the scrubber. An external canister protects the bag from accidental damage.

A THIRD EXAMPLE, U.S. Pat. No. 5,445,475 to Fujino teaches a floating up guide device that has an external wall portion forming a floating up guide device body and a hollow interior portion defined within the external wall. The external wall portion forming the floating up guide device body being formed of a hard material which does not vary the volume of the hollow interior portion. The hollow interior portion being sealingly enclosed by the external wall portion. A balancing member variable of weight being detachably attached on one end of the external wall portion.

A FOURTH EXAMPLE, U.S. Pat. No. 5,855,454 to Courtney et al. teaches a counterweight assembly to enhance heads up surface positioning of a person. The assembly includes a weight/ballast member strategically disposed on a cylinder/tank worn by a driver during a dive. The weight member can be attached by several different embodiments. Preferably the weight member is attached such that the diver cannot release or adjust the weight member while he or she is diving. The weight member rotates the person to ensure heads up surface positioning in the event the person becomes incapacitated. Also provided are several other water safety and survival devices.

A FIFTH EXAMPLE, U.S. Pat. No. 5,947,784 to Oullen teaches a device that produces toroidal bubbles of gaseous fluid when operated in immersed relation to a body of liquid fluid. A first embodiment is operated by a person who blows into a first end of the device with a short burst of air, and a second embodiment is operated by a pneumatic pump that delivers a short burst of air to the first end. A normally closed valve such as a popper valve is positioned on a second end of the device. The valve opens and closes very rapidly in response to the burst of air. Air escaping around the peripheral border of the valve creates a toroidal bubble that expands in volume as it approaches the surface of the liquid fluid; the effect is visually pleasing. The valve of the device may also be held in the mouth, eliminating the conduit. In additional embodiments, the source of gaseous fluid is any pneumatically-charged device.

It is apparent that numerous innovations for water related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a personal water rescue device that avoids the disadvantages of the prior art.

ANOTHER OBJECT of the present invention is to provide a personal water rescue device that is simple to use.

BRIEFLY STATED, STILL ANOTHER OBJECT of the present invention is to provide a personal water rescue device. A gas device is connected to a housing and releases gas bubbles. A light device is contained within the housing and illuminates the gas bubbles. The light device includes a pair of vials that contain chemicals that when mixed form chemical illuminance and which communicate with inwardly deformable bulging ribs on the housing so as to allow mixing the chemicals and forming the chemical illuminance when the inwardly deformable bulging ribs are squeezed and their displacement ruptures the pair of vials. A tubular member of the housing terminates in a pin that punctures the gas device when the tubular member is further threaded into a connector sleeve of the housing, and in so doing, releases the gas bubbles for heads up surface positioning for a disoriented water victim, while the chemical illuminance from the light device provides illumination therefor.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of a disoriented water victim with the present invention prior to use;

FIG. 2 is an enlarged diagrammatic perspective view of the area generally enclosed by the dotted curve identified by arrow 2 in FIG. 1 of the present invention being held in one hand of the disoriented water victim;

FIG. 3 is a diagrammatic perspective view of the present invention being activated by the two hands of the disoriented water victim;

FIG. 4 is a diagrammatic perspective view of the activated present invention;

FIG. 5 is a diagrammatic perspective view of the water victim properly oriented as a result of the present invention;

LIST OF REFERENCE NUMERALS UTILIZED IN THE DRAWING

Preferred Embodiment

Figure 7:
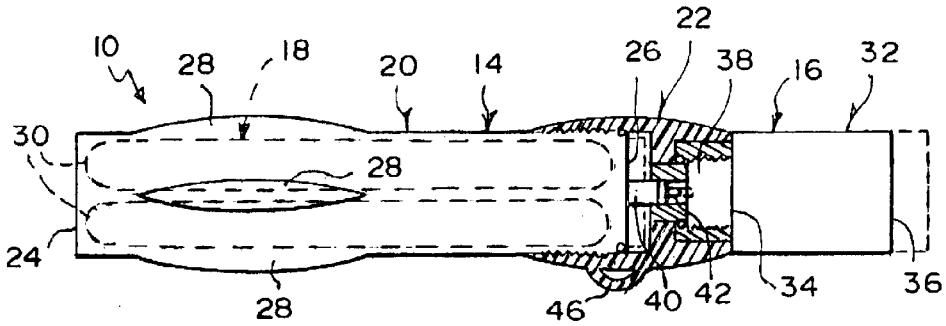
FIG. 7 is a diagrammatic partial cross sectional view taken along line 7—7 in FIG. 6.

10 personal water rescue device of present invention for being held in one hand by disoriented water victim 12, being activated by two hands of disoriented water victim 12, and properly orienting disoriented water victim 12
11 hand of a disoriented water victim 12
12 disoriented water victim
14 housing
16 gas device for releasing gas bubbles so as to form bubble trail for heads up surface positioning for disoriented water victim 12
18 light device for illuminating bubble trail
19 gas bubbles
20 tubular member of housing 14
22 connector sleeve of housing 14
24 proximal end of tubular member 20 of housing 14
26 distal end of tubular member 20 of housing 14
28 inwardly deformable bulging ribs of tubular member 20 of housing 14
30 pair of vials of light device 18
32 pressurized can of gas of gas device 16
34 proximal end of pressurized can of gas 32 of gas device 16
36 distal end of pressurized can of gas 32 of gas device 16
38 neck of proximal end 34 of pressurized can of gas 32 of gas device 16
40 neck of distal end 26 of tubular member 20 of housing 14
42 pin of neck 40 of distal end 26 of tubular member 20 of housing 14
44 through bores around connector sleeve 22 of housing 14
46 loop of connector sleeve 22 of housing 14
48 strap of connector sleeve 22 of housing 14

Alternate Embodiment

110 personal water rescue device of present invention
114 housing
120 semi-ellipsoid member of housing 114
116 gas device
122 connector sleeve of housing 114

DETAILED DESCRIPTION OF THE PREFERRED EMBODIMENT

Referring now to the figures, in which like numerals indicate like parts, and particularly to FIGS. 1–5, the personal water rescue device of the present invention is shown generally at 10, respectively, for being held in one hand 11 by a disoriented water victim 12, for being activated by two hands 11 of the disoriented water victim 12, and for properly orienting the disoriented water victim 12.

Figure 6:
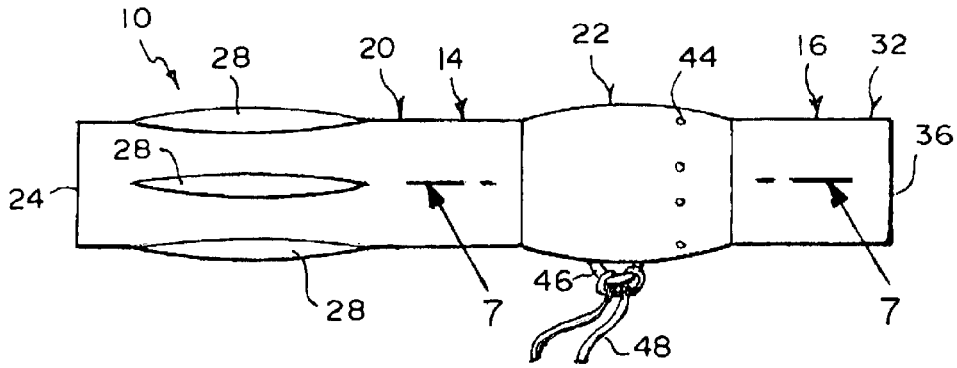
FIG. 6 is an enlarged diagrammatic side elevational view of the area generally enclosed by the dotted curve identified by arrow 6 in FIG. 2 of the present invention.

The configuration of the personal water rescue device 10 can best be seen in FIGS. 6 and 7, and as such, will be discussed with reference thereto.

The personal water rescue device 10 comprises a housing 14, a gas device 16, and a light device 18. The gas device 16 is operatively connected to the housing 14 and is for releasing gas bubbles 19 so as to form a bubble trail for heads up surface positioning for the disoriented water victim 12, and the light device 18 is operatively contained within the housing 14 and is for illuminating the bubble trail.

The housing 14 comprises a tubular member 20 and a connector sleeve 22. The tubular member 20 contains the light device 18 and is coaxially and partially threaded into one end of the connector sleeve 22, while the gas device 16 is coaxially threaded into the other end of the connector sleeve 22.

The tubular member 20 has a proximal end 24, a distal end 26, and inwardly deformable bulging ribs 28. The inwardly deformable bulging ribs 28 extend axially along the tubular member 20 in proximity of the proximal end 24 thereof.

The light device 18 comprises a pair of vials 30. The pair of vials 30 extend axially in the tubular member 20, contain chemicals that when mixed form chemical illuminance, and communicate with the inwardly deformable bulging ribs 28 so as to allow mixing the chemicals contained in the pair of vials 30 and forming the chemical illuminance when the inwardly deformable bulging ribs 28 are squeezed and their displacement ruptures the pair of vials 30.

The gas device 16 comprises a pressurized can of gas 32. The pressurized can of gas 32 has a proximal end 34 and a distal end 36. The proximal end 34 of the pressurized can of gas 32 has a neck 38. The neck 38 is coaxially threaded into the other end of the connector sleeve 22.

The distal end 26 of the tubular member 20 is coaxially and partially threaded into the one end of the connector sleeve 22 and has a neck 40. The neck 40 extends coaxially into the connector sleeve 22 and terminates in a pin 42. The pin 42 punctures the pressurized can of gas 32 when the tubular member 20 is further threaded into the connector sleeve 22, and in so doing, releases the gas bubbles 19 so as to form the bubble trail for the heads up surface positioning for the disoriented water victim 12 that escapes from through bores 44 that extend circumferentially around the connector sleeve 22, while the chemical illuminance from the light device 18 provides illumination therefor.

The connector sleeve 22 further has a loop 46 thereon and a strap 48. The strap 48 laps through the loop 46 and provides a wrist grasp for holding by the disoriented water victim 12.

Figure 8:
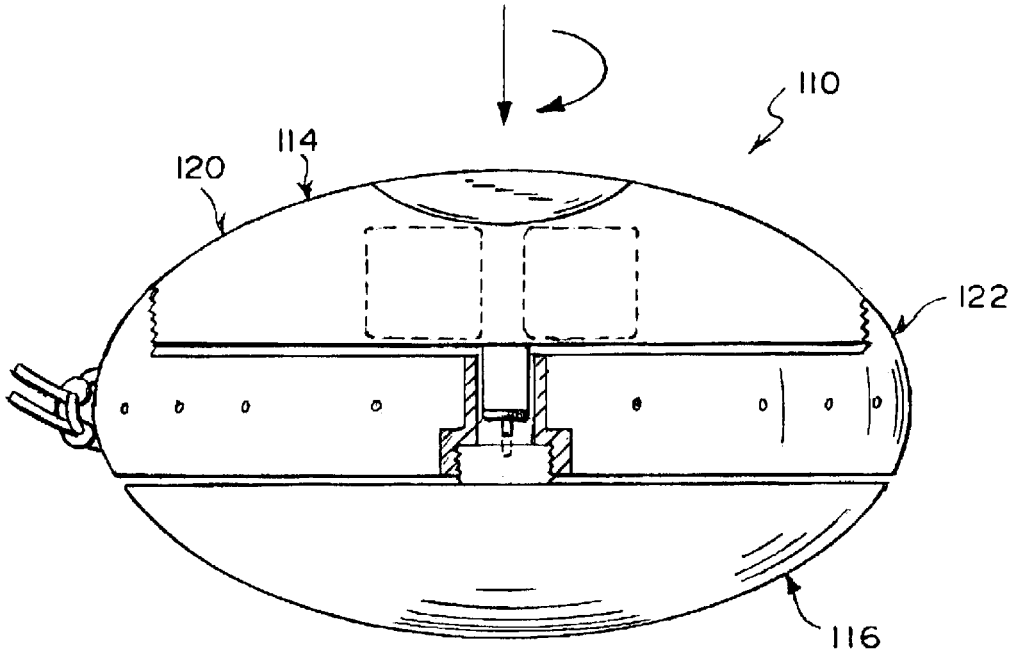
FIG. 8 is a diagrammatic side elevational view in partial section of an alternate embodiment of the present invention.

The configuration of an alternate embodiment of the personal water rescue device 110 can best be seen in FIG. 8, and as such, will be discussed with reference thereto.

The personal water rescue device 110 is similar to the personal water rescue device 10, except that the tubular member 20 now forms the housing 114 which is a semi-ellipsoid member 120, the gas device 116 is semi-ellipsoid-shaped, and the connector sleeve 122 is ring-shaped so as to form an ellipsoid shape for the personal water rescue device 110.

It will be understood that each of the elements described above, or two or more together, may also find a useful application in other types of constructions differing from the types described above.

While the invention has been illustrated and described as embodied in a personal water rescue device, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A personal water rescue device for being held in one hand by a disoriented water victim, being activated by two hands of the disoriented water victim, and properly orienting the disoriented water victim, said device comprising:

A) a housing;

B) a gas device; and

C) a light device;

wherein said gas device is operatively connected to said housing;

wherein said gas device is for releasing gas bubbles so as to form a bubble trail for heads up surface positioning for the disoriented water victim;

wherein said light device is operatively contained within said housing; and wherein said light device is for illuminating said bubble trail, wherein said housing comprising:

i) a tubular member; and ii) a connector sleeve;

wherein said tubular member contains said light device;

wherein said tubular member is coaxially threaded into one end of said connector sleeve;

wherein said tubular member is partially threaded into said one end of said connector sleeve; and wherein said gas device is coaxially threaded into other end of said connector sleeve, wherein said tubular member has:

a) a proximal end;

b) a distal end; and c) inwardly deformable bulging ribs;

wherein said inwardly deformable bulging ribs extend axially along said tubular member; and wherein said inwardly deformable bulging ribs extend in proximity of said proximal end of said tubular member.

2. The device as defined in claim 1, wherein said light device comprises a pair of vials wherein said pair of vials[]extend axially in said tubular member;

wherein said pair of vials contain chemicals that when mixed form chemical illuminance; and wherein said pair of vials communicate with said inwardly deformable bulging ribs so as to allow mixing said chemicals contained in said pair of vials and forming said chemical illuminance when said inwardly deformable bulging ribs are squeezed and their displacement ruptures said pair of vials.

3. The device as defined in claim 1, wherein said gas device comprises a pressurized can of gas;

wherein said pressurized can of gas has:

a) a proximal end; and b) a distal end;

wherein said proximal end of said pressurized can of gas has a neck; and wherein said neck is coaxially threaded into said other end of said connector sleeve.

4. The device as defined in claim 3, wherein said distal end of said tubular member is coaxially threaded into said one end of said connector sleeve;

wherein said distal end of said tubular member is partially threaded into said one end of said connector sleeve;

wherein said distal end of said tubular member has a neck;

wherein said neck extends coaxially into said connector sleeve;

wherein said neck terminates in a pin; and wherein said pin punctures said pressurized can of gas when said tubular member is further threaded into said connector sleeve, and in so doing, releases the gas bubbles so as to form the bubble trail for the heads up surface positioning for the disoriented water victim that escapes from through bores that extend circumferentially around said connector sleeve, while said chemical illuminance from said light device provides illumination therefor.

5. The device as defined in claim 1, wherein said connector sleeve has;

a) a loop; and b) a strap;

wherein said strap laps through said loop; and wherein said strap provides a wrist grasp for holding by the disoriented water victim.

* * * * *